US011493056B2

(12) United States Patent
Muley et al.

(10) Patent No.: US 11,493,056 B2
(45) Date of Patent: Nov. 8, 2022

(54) BLOWER HOUSING FOR BLOWER OF HVAC SYSTEM

(71) Applicant: Johnson Controls Technology Company, Auburn Hills, MI (US)

(72) Inventors: Kirankumar A. Muley, Pune (IN); Pankaj B. Avhad, Nashik (IN); Sumedh J. Suryawanshi, Pune (IN); Tukaram R. Suryawanshi, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 311 days.

(21) Appl. No.: 16/725,924

(22) Filed: Dec. 23, 2019

(65) Prior Publication Data

US 2021/0190090 A1 Jun. 24, 2021

(51) Int. Cl.

| | |
|---|---|
| ***F04D 29/42*** | (2006.01) |
| ***F24F 13/08*** | (2006.01) |
| *F24F 13/20* | (2006.01) |

(52) U.S. Cl.

CPC ..... *F04D 29/4233* (2013.01); *F04D 29/422* (2013.01); *F24F 13/081* (2013.01); *F24F 2013/205* (2013.01)

(58) Field of Classification Search

CPC . F04D 29/4226; F04D 29/4233; F04D 29/422
See application file for complete search history.

(56) References Cited

U.S. PATENT DOCUMENTS

| | | | | |
|---|---|---|---|---|
| X960815 | | 6/1910 | Carlisle | |
| 2,801,042 | A | 7/1957 | Thygeson | |
| 10,895,266 | B2 * | 1/2021 | Pirouzpanah | F04D 29/462 |
| 11,193,499 | B2 * | 12/2021 | Pirouzpanah | F04D 29/422 |
| 11,274,677 | B2 * | 3/2022 | Chinoda | F04D 29/4206 |
| 2017/0342992 | A1 * | 11/2017 | Pirouzpanah | F04D 29/283 |

FOREIGN PATENT DOCUMENTS

| | | | |
|---|---|---|---|
| GB | 2393220 | A | 3/2004 |
| KR | 100637337 | B1 | 10/2006 |
| KR | 20070034669 | A | 3/2007 |
| KR | 100845289 | B1 | 7/2008 |

* cited by examiner

*Primary Examiner* — Sabbir Hasan
(74) *Attorney, Agent, or Firm* — Fletcher Yoder, P.C.

(57) ABSTRACT

A blower assembly for a heating, ventilation, and/or air conditioning (HVAC) system includes a centrifugal fan having a fan wheel. A plurality of blades are coupled to the fan wheel at an inner blade boundary and extend radially to an outer blade boundary. The blower assembly includes a first housing panel and a second housing panel disposed on opposite sides of the centrifugal fan and extending transverse to the centrifugal fan. The blower assembly includes a wall extending between the first housing panel and the second housing panel and a flange extending from the wall at a vertex. The flange extends outwardly from the wall. A first radial distance from the vertex to the outer blade boundary is between 4 percent and 20 percent of a second radial distance from a rotational axis of the centrifugal fan to the outer blade boundary.

11 Claims, 8 Drawing Sheets

BLOWER HOUSING FOR BLOWER OF HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may regulate such environmental properties through control of an air flow delivered to the environment by a blower assembly. For example, the blower assembly may be configured to direct air across a heat exchanger of the HVAC system to facilitate exchange of thermal energy between the air and a refrigerant flowing through tubes of the heat exchanger. The blower assembly may further direct the conditioned air discharging from the heat exchanger to rooms or spaces within a building or other suitable structure serviced by the HVAC system.

Typical blower assemblies include a rotor that is positioned within a housing of the blower assembly and is configured to rotate relative to the housing. In particular, the rotor may be configured to draw air into the housing from a surrounding environment and to force the air across a heat exchange area of the heat exchanger. In some cases, the rotor may recirculate a portion of the air that is drawn into the housing back through the housing instead of discharging the air through an outlet of the blower assembly. Unfortunately, conventional blower housings may be inadequately designed to effectively block air recirculation through the blower housing, thereby reducing an overall operational efficiency of the blower assembly.

SUMMARY

The present disclosure relates to a blower assembly for a heating, ventilation, and/or air conditioning (HVAC) system, where the blower assembly includes a centrifugal fan. The centrifugal includes a fan wheel and a rotational axis. A plurality of blades are coupled to the fan wheel at an inner blade boundary and extend radially outwardly from the fan wheel to an outer blade boundary. A first housing panel and a second housing panel are disposed on opposite sides of the centrifugal fan and extend transverse to the rotational axis of the centrifugal fan. A wall extends about the rotational axis and between the first housing panel and the second housing panel. A flange extends from the wall at a vertex and extends outwardly, with respect to the rotational axis, from the wall. A first radial distance from the vertex to the outer blade boundary is between 4 percent and 20 percent of a second radial distance from the rotational axis to the outer blade boundary.

The present disclosure also relates to a blower having a centrifugal fan and a fan wheel, where the fan wheel includes a rotational axis. The blower includes a plurality of blades, where each blade of the plurality of blades includes an inner blade boundary coupled to the fan wheel and a body that extends radially outwardly from the fan wheel to an outer blade boundary. The blower includes a blower housing having a first housing panel and a second housing panel that are disposed on opposite sides of the centrifugal fan and extend transverse to the rotational axis of the fan wheel. The blower housing includes a wall extending about the rotational axis and between the first housing panel and the second housing panel. The blower housing includes flange having a camber geometry and extending outwardly from an edge of the wall, where a length of the flange is between 10 percent and 30 percent of a radial distance from the rotational axis to the outer blade boundary, a distal end of the flange is positioned away from the wall by a radial distance of between 2 percent and 10 percent of the radial distance from the rotational axis to the outer blade boundary, or both.

The present disclosure also relates to a blower for a heating, ventilation, and/or air conditioning (HVAC) system. The blower includes a centrifugal fan having a fan wheel and a rotational axis. The blower includes a plurality of blades extending from the fan wheel, where each blade of the plurality of blades is coupled to the fan wheel at an inner blade boundary and extends outwardly from the fan wheel to an outer blade boundary. The blower includes a blower housing having a first housing panel and a second housing panel that are disposed on opposite sides of the centrifugal fan and extend transverse to the rotational axis of the centrifugal fan. The blower housing includes a wall extending about the rotational axis and between the first housing panel and the second housing panel. The blower housing includes a cutoff plate coupled to the wall at a blower housing joint and extending about the rotational axis, where the cutoff plate includes a flange extending from a vertex of the cutoff plate. A first radial distance from the blower housing joint to the outer blade boundary is between 10 percent and 30 percent of a second radial distance from the rotational axis to the outer blade boundary, a third radial distance from the vertex to the outer blade boundary is between 4 percent and 20 percent of the second radial distance from the rotational axis to the outer blade boundary, or both.

DETAILED DESCRIPTION

Figure 1:
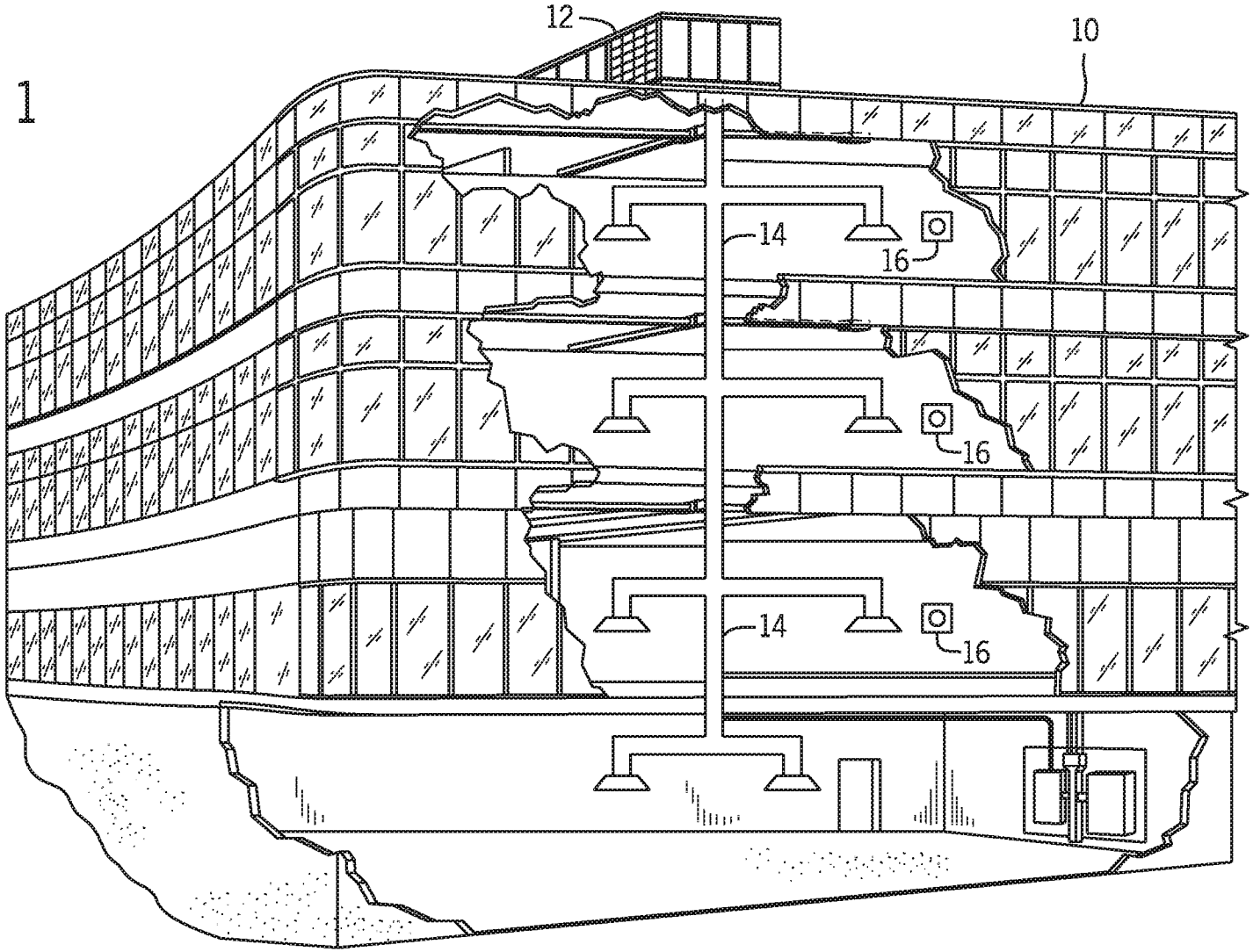
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. For example, the HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the refrigerant circuit and enable the transfer of thermal energy between the condenser and the evaporator.

The HVAC system generally includes a blower, also referred to herein as a blower assembly, which is configured to direct an air flow across the condenser and/or the evaporator to facilitate heat exchange between the air flow and the refrigerant circulating through the condenser and/or the evaporator. Conventional blower assemblies typically include a rotor that is positioned within a blower housing and is configured to rotate about an axis of the rotor. The blower housing may be formed from a first side panel and a second side panel that extend transverse to the rotational axis of the rotor and a wall, also referred to herein as a wrap, which extends between the first and second side panels and extends about a circumference of the rotor. Rotation of the rotor may draw an air flow into an inlet of the blower housing and may force the air flow through an outlet of the blower housing toward, for example, the evaporator or the condenser.

In many cases, the blower housing includes a cutoff plate that forms a portion of the wall of the blower housing and is configured to reduce a quantity of air that may be recirculated into the blower housing during rotation of the rotor. For clarity, as used herein, a "cutoff plate" may refer to a section of the wall that is positioned proximate to the outlet of the blower housing and that may define a portion of the outlet or outlet opening. Unfortunately, cutoff plates of typical blower housings are generally inadequately positioned, relative to other components of the blower housing, to effectively block air recirculation through the blower housing, thereby reducing an overall operational efficiency of the blower assembly. Moreover, conventional blower housings may be ill-suited for scalable implementation in various HVAC settings. Indeed, adjusting a size of conventional blower housings to accommodate, for example, a larger rotor, may result in an adjustment to a position of the cutoff plate relative to other components of the blower housing, thereby reducing an effectiveness of the cutoff plate. That is, adjusting conventional blower housings to receive another size or type of rotor may reduce an ability of the cutoff plate to receive and redirect air discharging from the rotor, and thus, reduce an overall operational performance of the blower assembly.

It is now recognized that adjusting a position of a cutoff plate, relative to other components of a blower housing, based on particular reference features of the blower housing and/or the rotor, may enable the cutoff plate to more effectively direct air discharging from a rotor toward an outlet of the blower housing. Moreover, it is now recognized that adjusting a geometry of the cutoff plate based on such reference features may enable scaling of the blower housing while maintaining a substantially constant and/or improved operational efficiency of the blower, thereby facilitating manufacture of the blower for implementation in variety of the HVAC applications.

Accordingly, embodiments of the present disclosure are directed toward a blower assembly including a blower housing having various air directing features, such as a cutoff plate, which are positioned, dimensioned, and/or geometrically proportioned or sized based on particular reference features of the blower housing and/or the rotor to improve an efficiency of the blower assembly and to facilitate scalable implementation of the blower assembly. Particularly, various features of the blower housing discussed herein may be oriented and/or otherwise positioned relative to one another based on the reference features to enable more effective operation of the blower assembly.

For example, in some embodiments, a reference feature of the blower assembly may include a rotor, also referred to herein as a centrifugal fan, of the blower assembly. Parameters including a position of the cutoff plate relative to the centrifugal fan, dimensions of the cutoff plate, and/or a geometry of the cutoff plate may be selected based on certain dimensions of the centrifugal fan to enable the cutoff plate to more effectively receive and redirect an air flow discharging from the centrifugal fan during operation of the blower. Moreover, by adjusting parameters of the cutoff plate based on the centrifugal fan, the blower housing may be scaled to adequately receive and redirect air discharging from the centrifugal fan, irrespectively of a size and/or a configuration of the centrifugal fan implemented in the blower assembly. Indeed, the blower housing may be suitably scaled based on the reference features to enable universal implementation of the blower assembly in a wide variety of HVAC applications, while mitigating the aforementioned shortcomings of typical blower assemblies. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
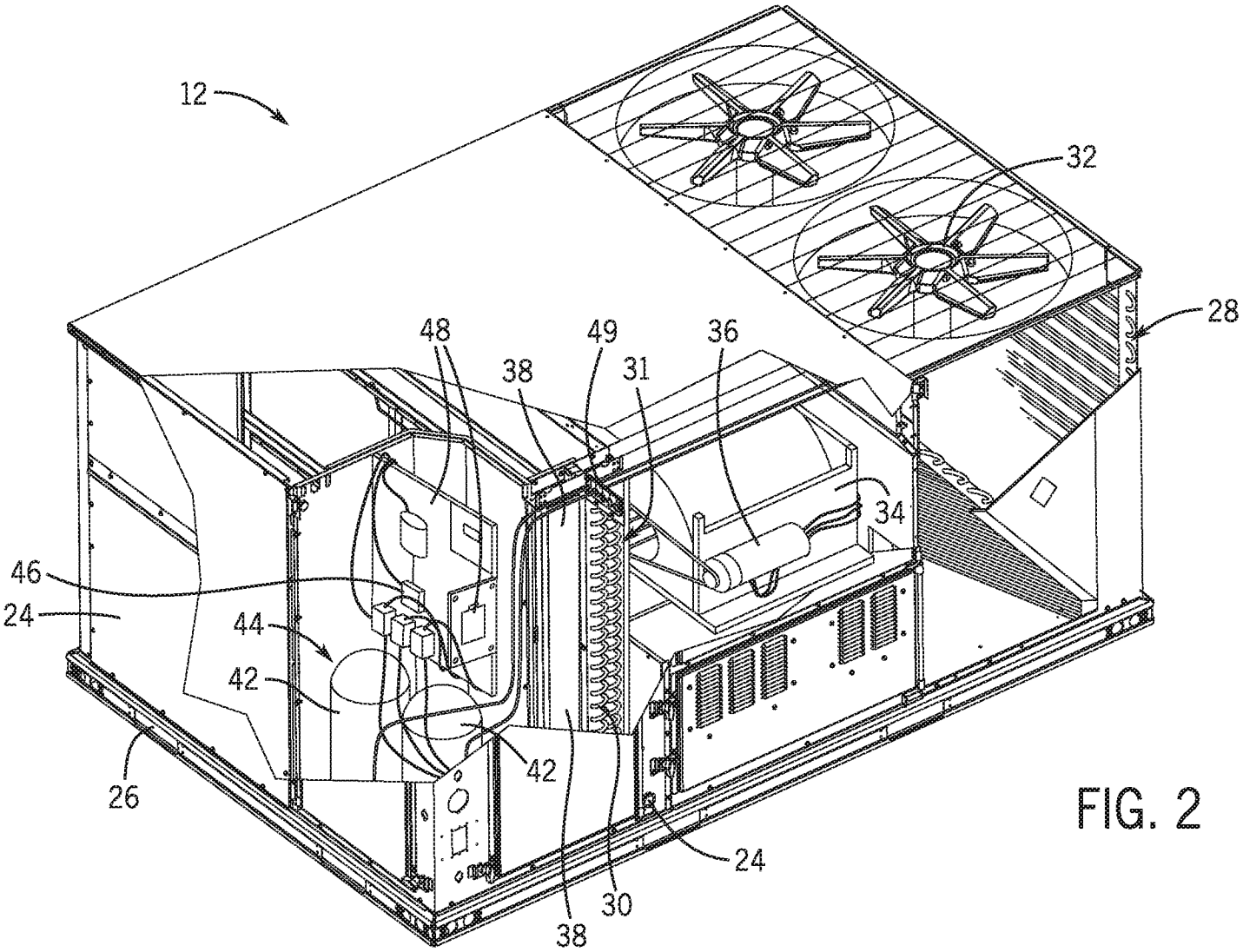
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
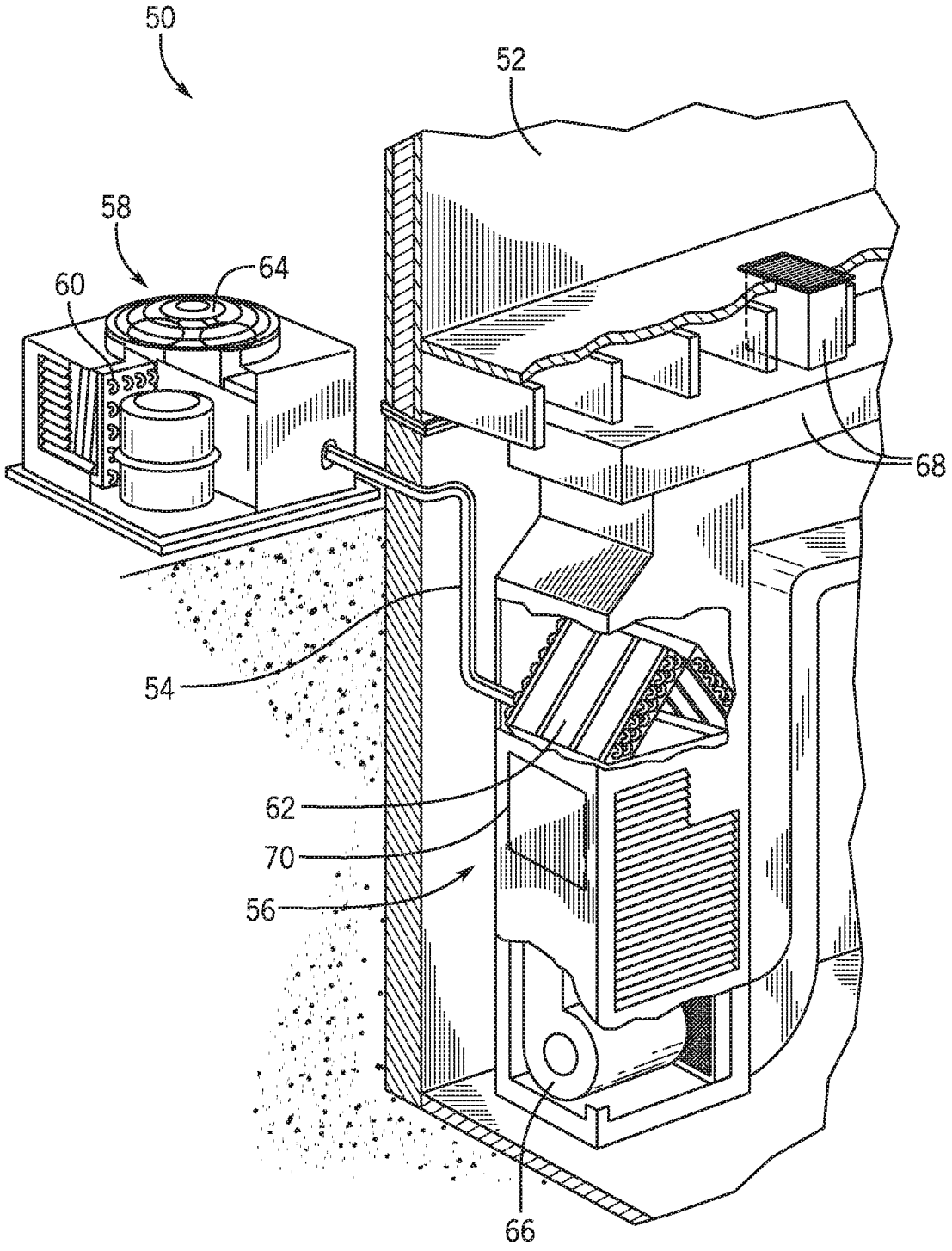
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
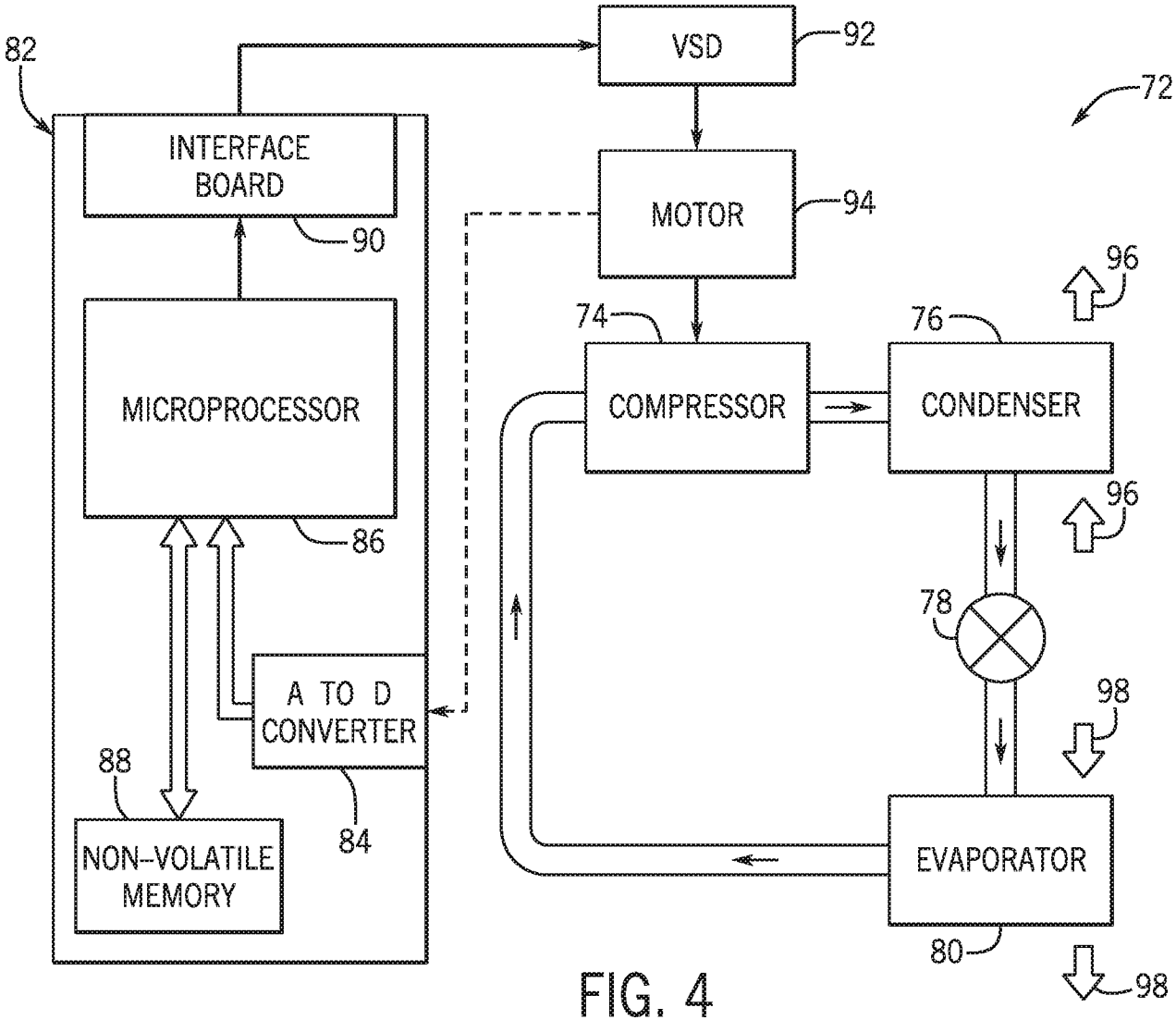
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, a blower assembly is typically used to direct an air flow across a heat exchanger or other component of an HVAC system, such as the heat exchangers 28, 30 of the HVAC unit 12 and/or the heat exchangers 60, 62 of the residential heating and cooling system 50. The blower assembly typically includes a blower housing having one or more air directing features that facilitate operation of the blower. For example, the blower housing typically includes a cutoff plate that is configured to reduce air recirculation within the blower housing during operation of the blower assembly. As noted above, embodiments of the present disclosure are directed to an improved blower housing having certain air directing features, such as the cutoff plate, which are adjusted based on particular reference features of the blower housing and/or centrifugal fan within the blower housing to enhance an operational performance of the blower assembly. In particular, the air directing features are adjusted to more effectively reduce air recirculation through the blower housing to reduce an amount of power consumed by a motor configured to drive rotation of the centrifugal fan, and thus, increase an overall operational efficiency of the blower assembly. Moreover, as discussed below, embodiments of the blower housing disclosed herein may be effectively scaled for implementation in various HVAC applications in order to improve an overall performance and/or operational efficiency of the blower assembly in multiple implementations.

Figure 5:
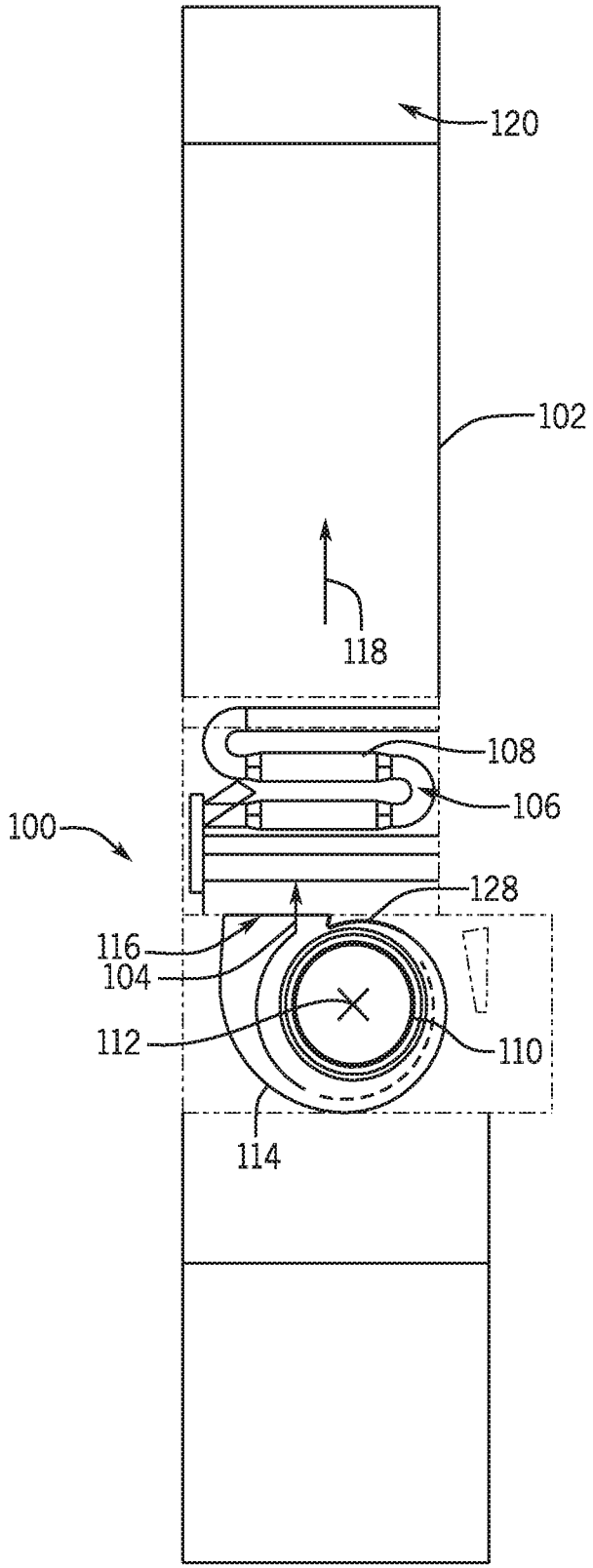
FIG. 5 is a side view of an embodiment of a blower assembly and a heat exchanger positioned within an air handling unit, in accordance with an aspect of the present disclosure.

With the foregoing in mind, FIG. 5 is a side view of an embodiment of a blower assembly 100, such as the blower assembly 34, which may be included in the HVAC unit 12, the split, residential heating and cooling system 50, a rooftop unit, or any other suitable HVAC system. In the illustrated embodiment, the blower assembly 100 is positioned within an air handling unit 102 and is configured to direct an air flow 104 across a heat exchanger 106. The heat exchanger 106 conditions the air flow 104 by placing the air flow 104 in thermal communication with a working fluid, such as refrigerant or combustion products, flowing through tubes 108 of the heat exchanger 106. The blower assembly 100 includes a centrifugal fan 110 that is configured to rotate about an axis 112 extending through a housing 114, also referred to herein as a blower housing, of the blower assembly 100. As the centrifugal fan 110 rotates about the axis 112, blades of the centrifugal fan 110 draw air into the housing 114 and increase a velocity of the air to generate the air flow 104. The air flow 104 is subsequently directed through an outlet 116 or an exhaust port of the housing 114 and is forced across the tubes 108 of the heat exchanger 106. After exchanging thermal energy with the working fluid in the heat exchanger 106, the air flow may 104 may discharge from the heat exchanger 106 as a conditioned air flow 118. The centrifugal fan 110 may direct the conditioned air flow 118 toward an outlet 120 of the air handling unit 102, which may be fluidly coupled to the building 10, such as via ductwork. In this manner, the blower assembly 100 may facilitate supply of the conditioned air flow 118 to rooms or spaces within the building 10. The blower assembly 100 may include various air directing features, such as a cutoff plate 128, which are adjusted or positioned based on certain reference features of the blower assembly 100 to enhance an efficiency of the blower assembly 100. Indeed, as discussed below, parameters of the cutoff plate 128 may be adjusted based on features of the centrifugal fan 110 to facilitate direction of the air flow 104 from the centrifugal fan 110 toward the heat exchanger 106 via the outlet 120 and to reduce an amount of air that is recirculated back into the housing 114 during operation of the blower assembly 100.

Figure 6:
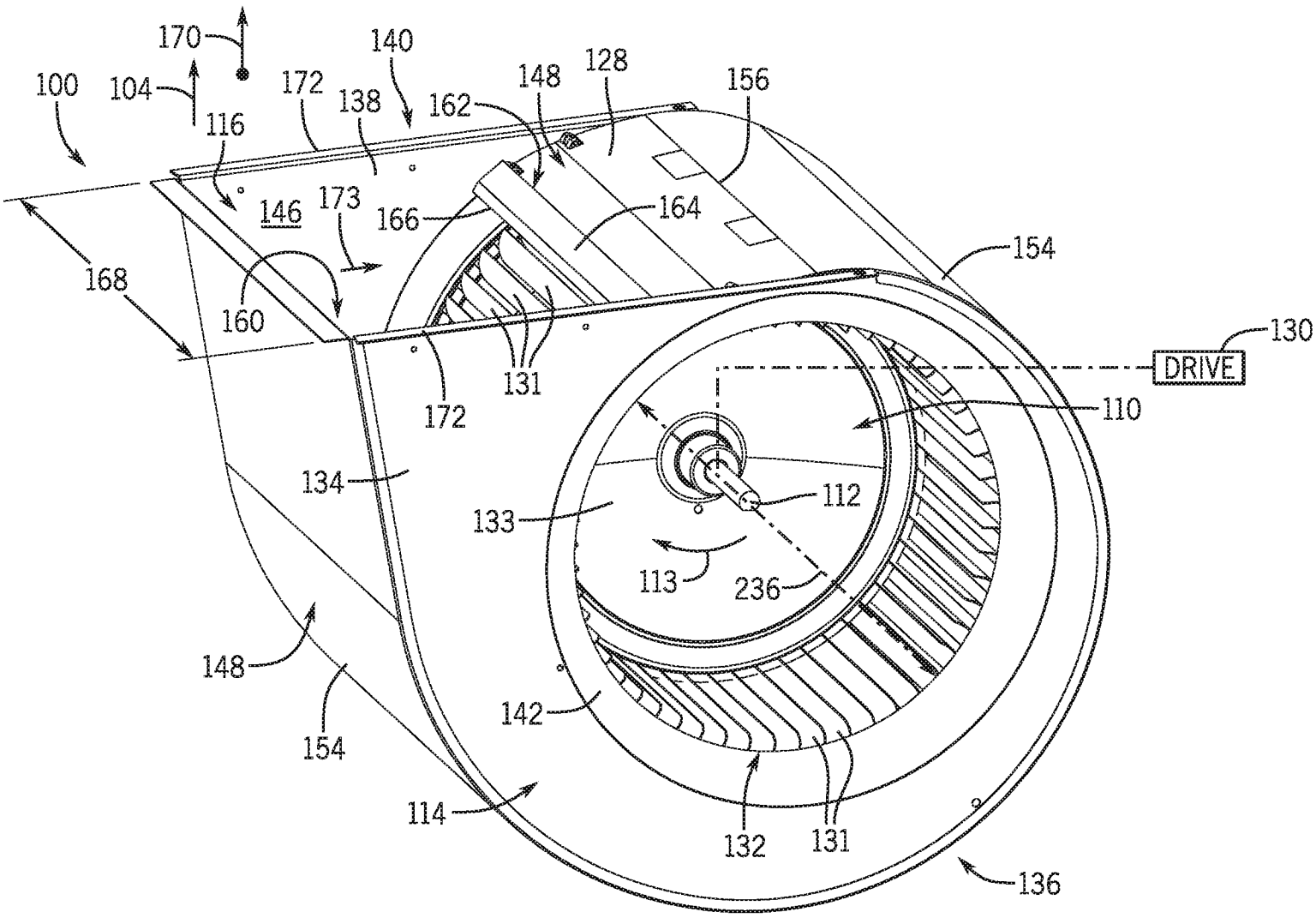
FIG. 6 is a perspective view of an embodiment of a blower assembly, in accordance with an aspect of the present disclosure.

FIG. 6 is a perspective view of an embodiment of the blower assembly 100. As shown in the illustrated embodiment, the blower assembly 100 includes the centrifugal fan 110 that is positioned within the housing 114 and is configured to rotate about the axis 112. The blower assembly 100 may include a drive 130, such as the motor 36, which is configured to rotate the centrifugal fan 110 about the axis 112 in a clockwise direction 113 relative to the housing 114. As the centrifugal fan 110 rotates about the axis 112, blades 131 extending from a fan wheel 133 of the centrifugal fan 110 may draw air into the housing 114 via an inlet 132 or intake passage that is formed within a first side panel 134, also referred to herein as a first housing panel, of the housing 114. The first side panel 134 is positioned on a first side 136 of the blower assembly 100 and is spaced apart from a second side panel 138, also referred to herein as a second housing panel, of the housing 114 that is positioned on a second side 140 of the blower assembly 100, opposite to the first side 136. It should be understood that, in some embodiments, the blower assembly 100 may also include an additional inlet that is formed within the second side panel 138 and is in fluid communication with the centrifugal fan 110.

In some embodiments, the inlet 132 may include an annulus having a curved face 142 that may facilitate drawing air into the housing 114 via the centrifugal fan 110. For example, during operation of the blower assembly 100, air may flow through the annulus and along, or against, the curved face 142, which may direct the air into the housing 114. As noted above, rotation of the centrifugal fan 110 may cause the air drawn into the housing 114 to increase in velocity and discharge from the housing 114 via the outlet 116 or exhaust port. As such, the air flow 104 may ultimately flow toward the heat exchanger 106, such as the heat exchanger 30. It should be appreciated that, in some embodiments, the blower assembly 100 may be positioned downstream of the heat exchanger 106, relative to a flow direction of the air flow 104, such that the blower assembly 100 draws the air flow 104 across the heat exchanger 106.

In some embodiments, the first side panel 134 and the second side panel 138 extend generally transverse to the axis 112 about which the centrifugal fan 110 rotates. In the illustrated embodiment, the housing 114 includes a wall 148 that extends generally parallel to the axis 112 between the first side panel 134 and the second side panel 138. In particular, the wall 148 extends about at least a portion of a circumference of the centrifugal fan 110 and, together the first side panel 134 and the second side panel 138, forms a chamber 146 within the housing 114. The cutoff plate 128 may form a portion of the wall 148 and, as such, may facilitate formation of the chamber 146.

For example, in some embodiments, a first portion of the wall 148 may include a casing wrapper 154, and a second portion of the wall 148 may include the cutoff plate 128. The casing wrapper 154 and the cutoff plate 128 may be bound by a joint 156, also referred to herein as a blower housing joint. For the purposes of this discussion, the joint 156 may be indicative of a crease, seam, or imaginary boundary between the cutoff plate 128 and the casing wrapper 154. For example, in some embodiments, the wall 148 may be a single-piece component having the cutoff plate 128 and the casing wrapper 154 formed integrally together. In such embodiments, the joint 156 may be indicative of an imaginary boundary between the casing wrapper 154 and the cutoff plate 128. In other embodiments, the cutoff plate 128 and the casing wrapper 154 may be initially formed as separate components that are coupled to one another at the joint 156 via suitable fasteners, adhesives, or via a metallurgical process, such as welding or brazing, to collectively form the wall 148. Accordingly, the joint 156 may be indicative of a physical interface between the casing wrapper 154 and the cutoff plate 128. In any case, the wall 148 may commence at a first end 160 that is positioned adjacent to the outlet 116 and may extend around the centrifugal fan 110 to a second end 162 or side of the outlet 116. As discussed below, the second end 162 may be a distal end of a flange 164 of the cutoff plate 128. It should be appreciated that the first side panel 134, the second side panel 138, and the wall 148 may be formed from sheet metal or another suitable metallic material. In other embodiments, the first side panel 134, the second side panel 138, and the wall 148 may be formed from a polymeric material or another suitable material.

As shown in the illustrated embodiment, the flange 164 extends from the cutoff plate 128 in a direction away or outwardly from the outlet 116 to form a vertex 166 or edge along a portion of the wall 148. As such, the vertex 166 may define a leading edge of the wall 148 that extends into and/or toward the chamber 146. The cutoff plate 128 may span between the first side panel 134 and the second side panel 138, such that the outlet 116 may be bound by a perimeter extending along the vertex 166, a portion of the first side panel 134, a portion of the second side panel 138, and a width 168 of the wall 148. Operation of the centrifugal fan 110 may force air entering the inlet 132 to flow along the wall 148 in the clockwise direction 113, such that the ingested air may be discharged from the chamber 146 via the outlet 116. That is, the air may be discharged from the chamber 146 in a first direction 170, thereby forming the air flow 104. In some embodiments, the first direction 170 extends generally orthogonal or cross-wise to respective end flanges 172 of the first and second side panels 134, 138, which may be used to couple the blower assembly 100 to the air handling unit 102.

In some embodiments, the centrifugal fan 110 may redirect a portion of the air within the chamber 146 back into the housing 114 instead of out of the housing 114 through the outlet 116, which may reduce an efficiency of the blower assembly 100. Accordingly, the cutoff plate 128 includes the flange 164, which includes a particular geometry, such as a camber geometry having an airfoil shape, which is configured to reduce an amount of air that is redirected back into the housing 114. Indeed, as shown in the illustrated embodiment, the flange 164 may include an airfoil shape that, as discussed below, may facilitate redirection of the air flow 104 discharging from the centrifugal fan 110 in the first direction 170 and may block air flow along a second direction 173 back into the housing 114.

Certain features of the cutoff plate 128, such as the flange 164, may include particular geometries and/or may be positioned at particular locations, relative to the housing 114 and/or the centrifugal fan 110, based on one or more reference features of the blower assembly 100. For clarity, as used herein, "reference features" of the blower assembly 100 may be indicative of certain components, elements, dimensions, arrangements, and/or configurations of the blower assembly 100 or components thereof that are used to determine one or more parameters, such as a geometry, scaling, and/or relative orientation or position, of other components of the blower assembly 100. As an example, in some embodiments, a dimension of the centrifugal fan 110 may be a reference feature of the blower assembly 100 that is used to determine one or more of the aforementioned parameters of the cutoff plate 128.

Figure 7:
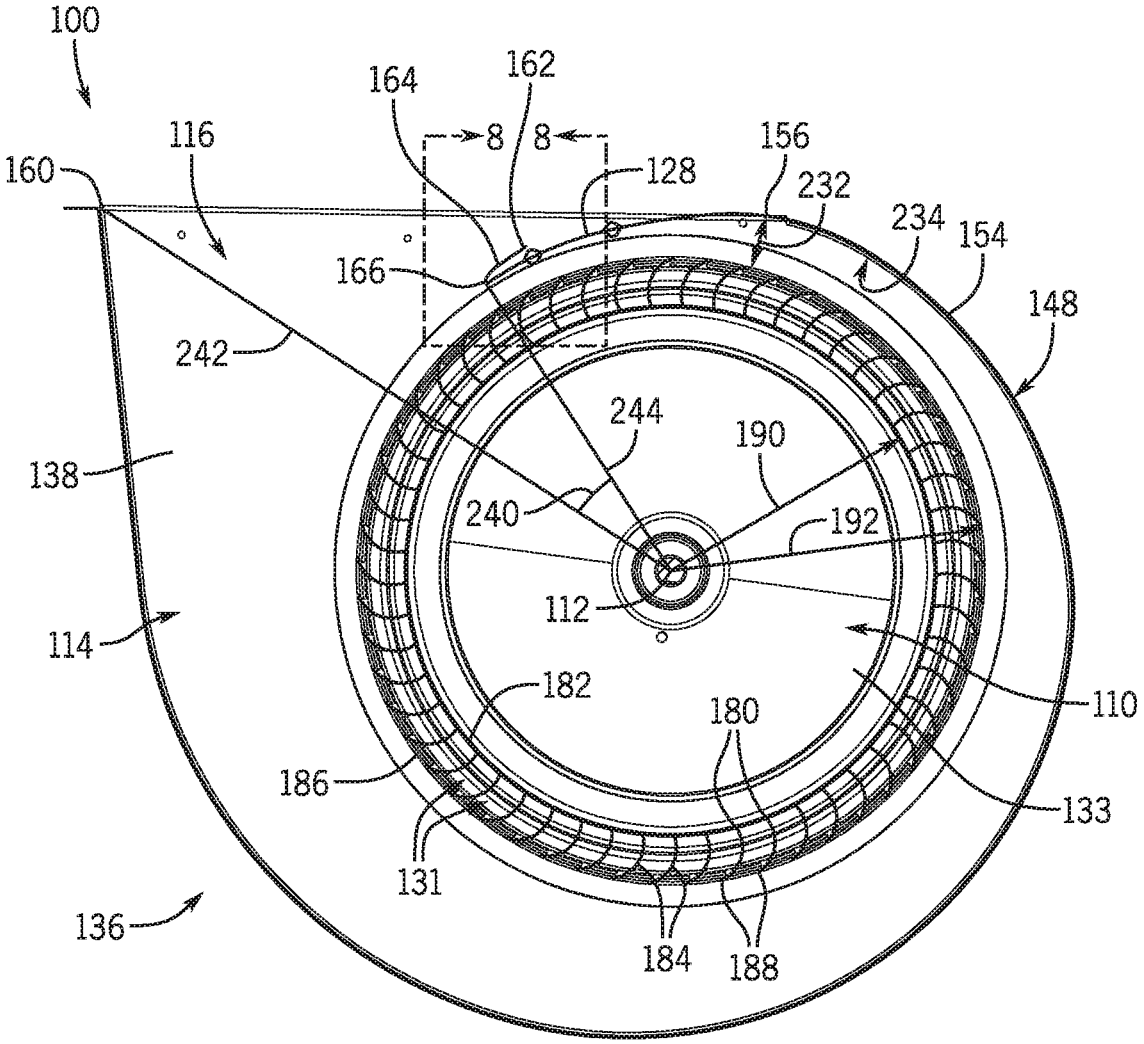
FIG. 7 is a cross-sectional side view of an embodiment of a blower assembly, in accordance with an aspect of the present disclosure.

To facilitate the following discussion, FIG. 7 is a cross-sectional side view of an embodiment of the blower assembly 100. As shown in the illustrated embodiment, each of the blades 131 include an inner blade tip, surface, or edge 180 that is coupled to the fan wheel 133. The inner blade tips 180 are coupled the fan wheel 133 along a circumferential boundary, referred to herein as an inner blade boundary 182, which extends about the axis 112. Each of the blades 131 includes a body 184 that extends generally radially outward, relative to the axis 112, from the inner blade boundary 182 to an outer blade boundary 186 that is defined by respective outer blade tips 188 of the blades 131. That is, the outer blade boundary 186 may be indicative of a circumferential boundary that extends about the outer blade tips 188 to generally define an overall outer diameter of the centrifugal can 110. For clarity, as used herein, a first radial distance extending between the axis 112 and the inner blade boundary 182 will be referred to as an inner radius 190 of the centrifugal fan 110. As used herein, a second radial distance extending between the axis 112 and the outer blade boundary 186 will be referred to as an outer radius 192 of the centrifugal fan 110.

Figure 8:
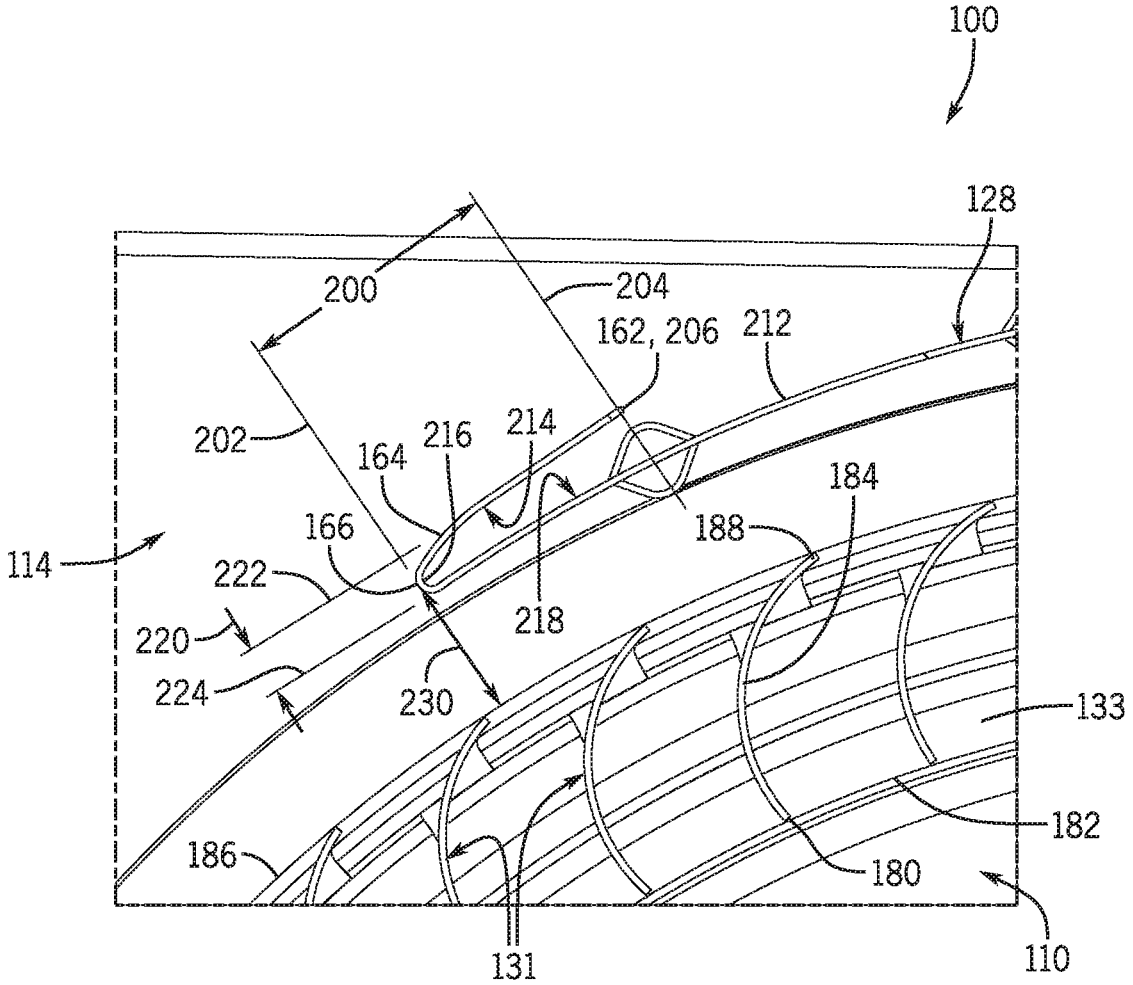
FIG. 8 is a partial cross-sectional side view, taken within line 8-8 of FIG. 7, of an embodiment of a blower assembly, in accordance with an aspect of the present disclosure.

As noted above, the centrifugal fan 110 may define a reference feature that is used to determine parameters of various other features of the housing 114, such as the cutoff plate 128. To better illustrate the cutoff plate 128 and to facilitate the following discussion, FIG. 8 is an expanded view of an embodiment of the blower assembly 100, taken along line 8-8 of FIG. 7. In some embodiments, a length 200 of the flange 164 may be determined based on features of the centrifugal fan 110. As used herein, the length 200 may be indicative of a distance that extends between a first line 202 that is generally tangent to the vertex 166 and a second line 204 that is substantially parallel to the first line 202 and that intersects a distal end 206 of the flange 164. For clarity, it should be appreciated that the distal end 206 of the flange 164 may be indicative of the second end 162 of the wall 148. As such, the length 200 may be indicative of a linear distance that extends between the first and second lines 202, 204, instead of a curved distance or an arc length that extends along a surface of the flange 164 between the vertex 166 and the distal end 206. In some embodiments, the length 200 of the flange 164 may be between about 10 percent and about 30 percent of a dimension of the outer radius 192, between about 16 percent and about 20 percent of the dimension of the outer radius 192, or about 18 percent of the dimension of the outer radius 192.

The cutoff plate 128 includes an exterior surface 212 that extends from the joint 156 to the distal end 206 of the flange 164. In particular, the exterior surface 212 includes a first surface section 214 that extends from the distal end 206 to an inner vertex 216 of the flange 164, which is proximate to the vertex 166. The exterior surface 212 includes a second surface section 218 that extends from the inner vertex 216 to the joint 156. Similar to the length 200 of the flange 164, in some embodiments, a height 220 or radial extension of the flange 164 may be determined based on features of the centrifugal fan 110. As used herein, the height 220 of the flange 164 may be indicative of a distance that extends between a third line 222 that is generally tangent to the first surface section 214, at the distal end 206, and a fourth line 224 that is substantially parallel to the third line 222 and that intersects the second surface section 218. As such, the height 220 may be indicative of a linear distance by which the distal end 206 of the flange 164 is positioned away or radially outward from a remaining portion of the wall 148, such as the second surface section 218. That is, the height 220 may be indicative of a distance between the first surface section 214, at the vertex 166, and the second surface section 218. In some embodiments, the height 220 of the flange 164 may be between about 2 percent and about 10 percent of a dimension of the outer radius 192, between about 4 percent and about 5 percent of a dimension of the outer radius 192, or about 4.5 percent of a dimension of the outer radius 192.

In some embodiments, the vertex 166 may be spaced apart from the outer blade boundary 186 by a first gap 230. The first gap 230 may be indicative of a radial distance, with respect to the axis 112, that extends between the vertex 166 and the outer blade boundary 186. In certain embodiments, the radial distance of the first gap 230 may be determined based on a dimension of the outer radius 192 of the centrifugal fan 110. For example, in some embodiments, the radial distance of the first gap 230 may be between about 4 percent and about 20 percent of the dimension of the outer radius 192, between about 8 percent and about 10 percent of the dimension of the outer radius, or about 9 percent of the dimension of the outer radius 192.

The following discussion continues with reference to FIG. 7. In certain embodiments, the joint 156 may be spaced apart from the outer blade boundary 186 by a second gap 232. The second gap 232 may be indicative of a radial distance, with respect to the axis 112, that extends between an inner surface 234 of the wall 148 at the joint 156 and the outer blade boundary 186. In certain embodiments, the radial distance of the second gap 232 may be determined based on the dimension of the outer radius 192 of the centrifugal fan 110. For example, in some embodiments, the radial distance of the second gap 232 may be between about 10 percent and about 30 percent of the dimension of the outer radius 192, between about 19 percent and about 20 percent of the dimension of the outer radius 192, or about 19.5 percent of the dimension of the outer radius 192.

In some embodiments, the inlet 132 of the blower assembly 100 may be a generally circular opening or intake passage that is formed within the housing 114. The inlet 132 may include a diametric dimension 236, as shown in FIG. 6, which extends between diametrically opposite points of the inlet 132. In some embodiments, the diametric dimension 236 may be determined based on a dimension of the inner radius 190 of the centrifugal fan 110. For example, in some embodiments, the diametric dimension 236 of the inlet 132 may be between about 5 percent and about 20 percent greater than the dimension of the inner radius 190, between about 10 percent and about 12 percent greater than the dimension of the inner radius 190, or about 11 percent greater than the dimension of the inner radius 190.

As noted above, the outlet 116 may be bound by a perimeter that extends along the vertex 166, a portion of the first side panel 134, a portion of the second side panel 138, and the width 168 of the wall 148, such as along a width of the first end 160 of the wall 148. A cross-sectional area of the outlet 116 may therefore depend on an exhaust angle 240 of the blower assembly 100. For clarity, as used herein, the exhaust angle 240 may be indicative of an angular dimension between a fifth line 242 that extends radially from the axis 112 to the first end 160 of the wall 148 and a sixth line 244 that extends radially from the axis 112 to the vertex 166. Accordingly, the exhaust angle 240 may be based on a position of the vertex 166, and thus the cutoff plate 128, relative to the centrifugal fan 110. In some embodiments, the exhaust angle 240 may be between about 10 degrees and about 40 degrees, between about 22 degrees and about 28 degrees, or about 25.63 degrees.

In some embodiments, dimensioning features of the blower assembly 100 in accordance with the aforementioned techniques may permit more effective operation of the blower assembly 100. In particular, tailoring certain blower features, such as the length 200 and the height 210 of the flange 164, a dimension of the first gap 230 between the vertex 166 and the outer blade boundary 186, a dimension of the second gap 232 between the joint 156 and the outer blade boundary 186, and/or the diametric dimension 236 of the inlet 132, to one or more reference features, such as a dimension of the centrifugal fan 110, may reduce regions of relatively stagnant air that may form within portions of the housing 114 during operation of the blower assembly 100. Indeed, such adjustments may facilitate fluid flow across the blades 131, thereby enhancing an overall operational efficiency of the blower assembly 100. Moreover, adjusting the aforementioned blower features based on the centrifugal fan 110 and/or other reference features of the blower assembly 100 facilitates implementation of the housing 114 with various sizes of centrifugal fans 110. That is, adjusting a geometry or position of, for example, the cutoff plate 128, based on a particular size of centrifugal fan 110 implemented in the blower assembly 100, may facilitate scaling and appropriate configuration of the housing 114 in order to achieve enhanced operational efficiency of the blower assembly 100. Indeed, by scaling and configuring the housing 114 in accordance with the techniques discussed above, dimensional ratios of the length 200, the height 210, the first gap 230, the second gap 232, and/or the diametric dimension 236, relative to the centrifugal fan 110, may remain substantially constant, irrespectively of a size of the centrifugal fan 110, thereby ensuring that an operational performance of the blower assembly 100 may be improved regardless of a size and/or a scaling of the blower assembly 100.

As set forth above, embodiments of the present disclosure may provide one or more technical effects useful for enhancing an operational efficiency of a blower assembly by selectively adjusting features of a blower housing based on certain reference features of the blower assembly. Moreover, by adjusting features of the blower housing based on such reference features, the blower housing may be tailored to accept a wide variety of components, such as various sizes of centrifugal fans, while improving an overall operational efficiency of the blower assembly. As such, the techniques disclosed herein facilitate manufacture of a blower housing for implementation in variety of the HVAC applications. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A blower assembly for a heating, ventilation, and/or air conditioning (HVAC) system, comprising:

a centrifugal fan having a fan wheel and a rotational axis;

a plurality of blades coupled to the fan wheel at an inner blade boundary and extending radially outwardly from the fan wheel to an outer blade boundary;

a first housing panel and a second housing panel disposed on opposite sides of the centrifugal fan and extending transverse to the rotational axis of the centrifugal fan;

a wall extending about the rotational axis and between the first housing panel and the second housing panel; and a flange extending from the wall at a vertex and extending outwardly, with respect to the rotational axis, from the wall, wherein a first radial distance from the vertex to the outer blade boundary is between 4 percent and 20 percent of a second radial distance from the rotational axis to the outer blade boundary.

2. The blower assembly of claim 1, wherein the first radial distance from the vertex to the outer blade boundary is between 8 percent and 10 percent of the second radial distance from the rotational axis to the outer blade boundary.

3. The blower assembly of claim 1, wherein a distal end of the flange is positioned radially outward, with respect to the rotational axis, of the wall by a height of between 2 percent and 10 percent of the second radial distance from the rotational axis to the outer blade boundary.

4. The blower assembly of claim 3, wherein the height is between 4 percent and 5 percent of the second radial distance from the rotational axis to the outer blade boundary.

5. The blower assembly of claim 3, wherein a linear dimension of the flange extending between the vertex and the distal end is between 10 percent and 30 percent of the second radial distance from the rotational axis to the outer blade boundary.

6. The blower assembly of claim 5, wherein the linear dimension of the flange is between 16 percent and 20 percent of the second radial distance from the rotational axis to the outer blade boundary.

7. The blower assembly of claim 1, wherein the flange is integrally formed with the wall, and the wall extends about the rotational axis from the vertex to an end portion of the wall positioned proximate an outlet of the blower assembly.

8. The blower assembly of claim 1, comprising an intake passage extending through the first housing panel to facilitate fluid flow to the centrifugal fan, wherein a diameter of the intake passage is 10 percent to 12 percent greater than a third radial distance from the rotational axis to the inner blade boundary.

9. The blower assembly of claim 1, wherein a distal end of the flange is positioned radially outward, with respect to the rotational axis, of the wall, wherein a third radial distance between the distal end and the wall is between 4 percent and 5 percent of the second radial distance from the rotational axis to the outer blade boundary.

10. The blower assembly of claim 1, wherein the vertex defines a first edge, and the wall extends about the rotational axis from the first edge to a second edge, and wherein an outlet of the blower assembly is formed by the first edge, the second edge, the first housing panel, and the second housing panel.

11. The blower assembly of claim 10, wherein an angular dimension of the fan wheel from the first edge to the second edge is between 22 degrees and 28 degrees.

* * * * *